US005428854A

United States Patent [19]

Rief et al.

[11] Patent Number: 5,428,854

[45] Date of Patent: Jul. 4, 1995

[54] REPLACEABLE BRUSH RINGS FOR POOL CLEANERS

[75] Inventors: Dieter J. Rief, Rohnert Park; Herman E. Frentzel, Sausalito, both of Calif.

[73] Assignee: Sta-Rite Industries, Inc., Delavan, Wis.

[21] Appl. No.: 147,824

[22] Filed: Nov. 3, 1993

Related U.S. Application Data

[63] Continuation-in-part of Ser. No. 52,699, Apr. 30, 1993, Pat. No. 5,293,659, which is a continuation of Ser. No. 771,787, Oct. 4, 1991, abandoned, which is a continuation of Ser. No. 758,005, Sep. 12, 1991, abandoned, which is a continuation-in-part of Ser. No. 586,425, Sep. 21, 1990, abandoned.

[51] Int. Cl.[6] ..... E04H 4/16

[52] U.S. Cl. ..... 15/1.7

[58] Field of Search ..... 15/1.7, 398, 399, 400

[56] References Cited

U.S. PATENT DOCUMENTS

| | | | |
|---|---|---|---|
| 1,403,524 | 1/1922 | Replogle | 15/400 |
| 2,321,231 | 6/1943 | Missmer | 15/400 X |
| 2,682,675 | 7/1954 | Prucha | 15/400 X |
| 2,730,753 | 1/1956 | Gerber | 15/400 X |
| 3,795,027 | 3/1974 | Lindberg, Jr. | 15/1.7 |
| 3,803,658 | 4/1974 | Raubenheimer . | |
| 3,979,788 | 9/1976 | Strausak . | |
| 4,023,227 | 5/1977 | Chauvier . | |
| 4,275,474 | 6/1981 | Woodard . | |
| 4,449,265 | 5/1984 | Hoy . | |
| 4,498,206 | 2/1985 | Braukmann | 15/1.7 |
| 4,536,908 | 8/1985 | Raubenheimer . | |
| 4,686,728 | 8/1987 | Rawlins . | |
| 4,692,956 | 9/1987 | Kassis . | |
| 4,722,110 | 2/1988 | Chandler . | |
| 4,835,809 | 6/1989 | Roumagnac . | |
| 4,837,886 | 6/1989 | Rawlins | 15/1.7 |
| 5,093,950 | 3/1992 | Heier . | |
| 5,097,559 | 3/1992 | Brunt et al. . | |
| 5,099,535 | 3/1992 | Chauvier et al. . | |

FOREIGN PATENT DOCUMENTS

| | | |
|---|---|---|
| 648893 | 12/1978 | Switzerland . |

*Primary Examiner*—Edward L. Roberts, Jr.
*Attorney, Agent, or Firm*—Jansson & Shupe, Ltd.

[57] ABSTRACT

A replaceable bristle ring for removable attachment to a swimming pool cleaner, such bristle ring having bristles secured along it and projecting downwardly to terminate in bristle ends adapted to support the pool cleaner on a surface to be cleaned and means facilitating attachment with respect to the pool cleaner housing. A preponderance of the bristles are preferably inclined along lines which are skew lines with respect to the axis of the ring, such that vibration causes movement of the pool cleaner along a swimming pool bottom surface. A preferred replaceable ring has an annular surface with features for interengagement with another bristle ring.

8 Claims, 8 Drawing Sheets

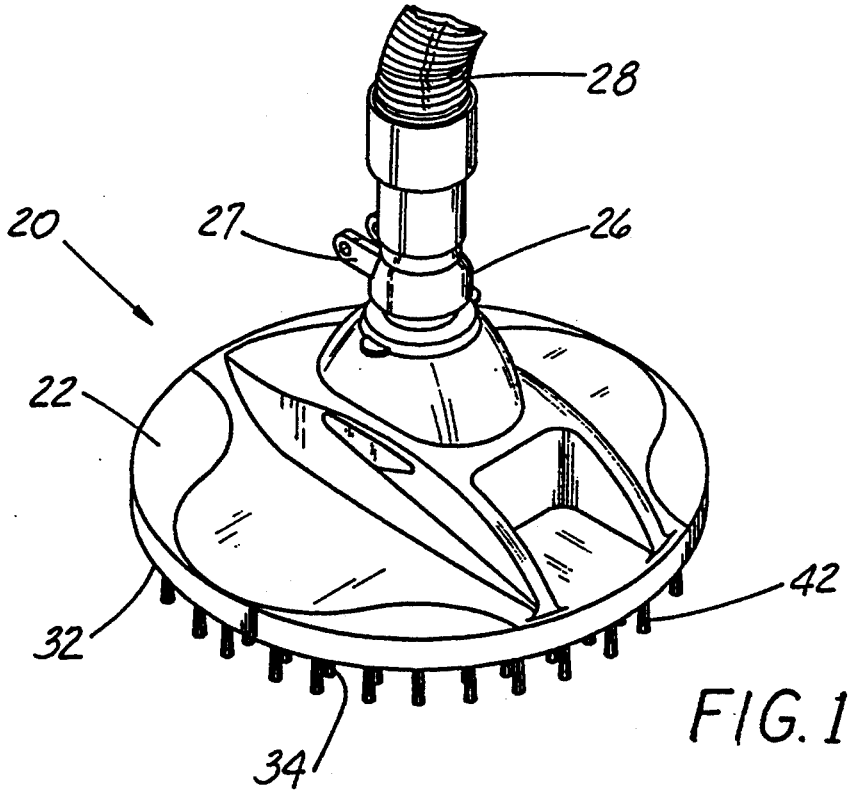
FIG. 1
FIG. 2
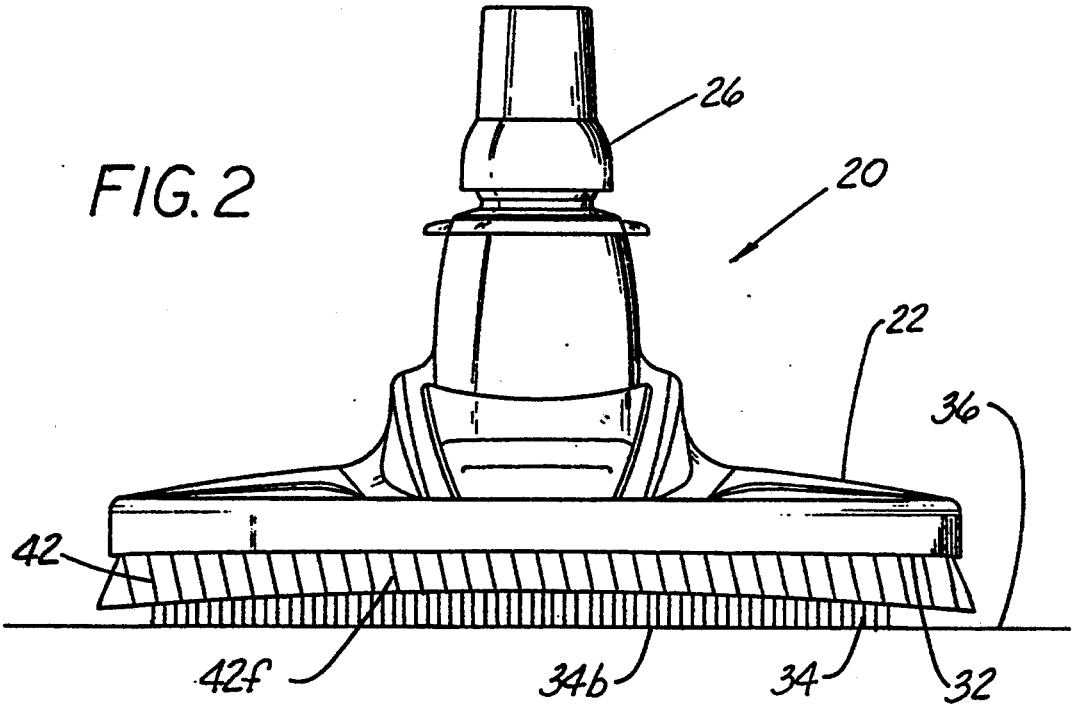

REPLACEABLE BRUSH RINGS FOR POOL CLEANERS

RELATED APPLICATIONS

This patent is a continuation-in-part of Ser. No. 08/052,699, now U.S. Pat. No. 5,293,659, filed Apr. 27, 1993, entitled AN AUTOMATIC SWIMMING POOL CLEANER, which is a continuation of Ser. No. 07/771,787, filed Oct. 4, 1991, and later abandoned, which is a continuation of Ser. No. 07/758,005, filed Sep. 12, 1991 and later abandoned, which is a continuation-in-part of Ser. No. 07,586,425, filed Sep. 21, 1990, and later abandoned.

FIELD OF THE INVENTION

This invention is related generally to swimming pool cleaners and, more particularly, to swimming pool cleaners which operate without human assistance.

BACKGROUND OF THE INVENTION

Automatic swimming pool cleaners are widely used to relieve swimming pool owners of the time-consuming and arduous task of hand-operated vacuuming of underwater surfaces. Such manual task, which typically involved the use of long extension handles and clumsy manipulation of a water-suction head held under water and at a distance, have largely been made a thing of the past by automatic systems. In recent decades, many automatic swimming pool cleaners of various types have been available and in wide use around the world.

A typical old-style automatic swimming pool cleaner has a suction head including a housing, a chamber open at its lower side, and a pivotable connector to which a long flexible hose is attached to allow movement of the swimming pool cleaner in the pool. The hose typically extends toward a remote pump which causes water flow from along the pool bottom surface, through the chamber and into the hose, removing dirt and debris from the bottom surface of the pool.

In old-style systems of this type, the flow of water caused by the pump is harnessed in various ways to cause movement of the swimming pool cleaner. In some old-style devices, the flow drives a turbine which in turn drives wheels or tracks by means of a gearing system. In other old-style devices, the water flow rate oscillates such that rapid intermittent surging of water flow causes movement along the underwater swimming pool surface.

There have been many problems and shortcomings with various old-style automatic swimming pool cleaners, and a clear need for improvement. Many of such devices are complex and expensive. Such devices also malfunction for various reasons, such as their frequent failure to move along the underwater pool surface as desired and intended.

"Bristle-drive" automatic swimming pool cleaners, as described in the United States patent mentioned above and in application Ser. No. 08/147,822, entitled DUAL-USE AND MANUAL POOL CLEANING APPARATUS, significant improvements in automatic swimming pool cleaners of the type having a suction-head housing, a chamber open at its lower side, and attachment means for a hose through which a remote pump causes water flow through the chamber and into the hose to remove dirt and debris from the underwater surface of the pool.

The pool cleaning apparatus of such patents include a vibrator device secured to the housing to vibrate the head in response to water flow through the chamber, and flexible bristles or the like secured with respect to the housing and projecting downwardly to free ends which support the pool cleaning apparatus on a swimming pool surface to be cleaned. A preponderance of the bristles are inclined (at an angle) in a common direction—a direction which is off-vertical when the pool cleaner is on a horizontal pool bottom surface, such that vibration causes forward head movement.

As described in such patents, water flow which is generated by the pump passes through an oscillator in the suction head causing a vibration of the suction head, and such vibration acts upon the brush bristles or other flexures, causing them to flex and causing the suction head to move forward as the bristles return to their normal straight configurations. The rapid repetition of this flexing and straightening of the bristles drives the suction head about the underwater surface of the swimming pool. And, in such motion, the bristles, which are vibrating from vibration of the suction head, scour the underwater pool surface which they contact. The dirt and debris displaced by such action is drawn up through the cleaner into a typical filter system, resulting in a thoroughly cleaned pool.

Some of the embodiments of the inventions described in such patents have annular groups of bristles—either one or two. In the case of the latter patent there are primary and secondary annular bristle groups. The primary annular group of bristles may be used for driving the pool cleaner in a forward direction, and the secondary annular group of bristles may be used to facilitate turning, by their contact with the pool bottom surface and/or when they contact pool side surfaces.

In some cases, bristles may require cleaning and such cleaning may be difficult to accomplish given the position of the bristles on the swimming pool cleaner. Also, bristles can wear out and require replacement, or 10 for one reason or another it may be desirable to replace one or more annular groups of bristles. For example, it may be desirable in some cases to change the drive or turning characteristics of a swimming pool cleaner, and this may best be accomplished by the use of differing bristle types or bristle arrangements.

There is a need for improved pool cleaning apparatus which accommodates cleaning of bristles forming part of the apparatus, which facilitates adjustment of the drive and turning characteristics of "bristle-drive" pool cleaners, and which in general facilitates removal and replacement of bristles.

OBJECTS OF THE INVENTION

It is an object of this invention to provide an improved automatic swimming pool cleaner which satisfies some of the unmet needs of swimming pool cleaning apparatus of the prior art.

Another object of this invention is to facilitate bristle replacement in "bristle-drive" pool cleaners.

Another object of this invention is to provide improved "bristle-drive" pool cleaning apparatus which accommodates bristle cleaning.

Another object of this invention is to provide improved "bristle-drive" pool cleaning apparatus which facilitates adjustment of the drive and/or turning characteristics determined by the bristles.

Another object of this invention is to provide an automatic swimming pool cleaner which reliably cleans the underwater surface of a swimming pool.

Another object of this invention is to provide an improved automatic swimming pool cleaner which is simple in construction and highly reliable in operation.

Another object of this invention is to provide an improved automatic swimming pool cleaner which may be readily adjusted to accommodate varying swimming pool bottom surfaces.

A still further object of this invention is to provide an improved automatic swimming pool cleaner which can be easily and rapidly disassembled for cleaning and maintenance purposes and re-assembled without the use of complex tools.

These and other important objects will be apparent from the descriptions and drawings herein.

SUMMARY OF THE INVENTION

This invention is an improvement in automatic swimming pool cleaners. The improvement accommodates cleaning of bristles forming part of automatic pool cleaners, facilitates adjustment of the drive and turning characteristics of "bristle-drive" pool cleaners, and in general facilitates removal and replacement of bristles. The improvement is a bristle ring which is detachably securable to the housing of the suction head, preferably along the lower edge thereof. Such bristle ring has bristles which project downwardly to terminate in bristle ends adapted to support the pool cleaner on a surface to be cleaned, and means on the ring to facilitate removable attachment of the ring to the housing.

In preferred embodiments, a preponderance of the bristles are inclined along lines which are skew lines with respect to the axis of the bristle ring. In such embodiments, skewing is such that vibration of the housing causes movement of the pool cleaner along a swimming pool bottom surface.

In highly preferred embodiments of this invention, the bristle ring has an annular surface with features adapted for interengagement with another bristle ring. Such annular surface of the first-mentioned bristle ring is most preferably complementary to an adjoining annular surface of the other bristle ring. This can facilitate joint mounting of two bristle rings to the housing—one a main-bristle drive ring for causing forward motion and the other a secondary-bristle ring for causing turning of the forward motion of the cleaner.

A more detailed description of a highly preferred form of automatic swimming pool cleaner with replaceably attachable bristle rings as described will be helpful. Such pool cleaner has a housing, a chamber open at the lower side of the housing, and a hose connection on the housing allowing connection of a hose through which a remote suction pump causes water flow through the chamber and into the hose to remove dirt and debris from the underwater surface of a pool. The apparatus includes a vibrator device secured to the housing to vibrate the head, preferably in response to water flow through the chamber, flexible main bristles on a main-bristle ring which is removably secured with respect to the housing, and flexible secondary bristles on a secondary-bristle ring which is also removably secured with respect to the housing.

The main bristles project downwardly to terminate in free main-bristle ends which are preferably disposed substantially in a common plane and adapted to support the head on a swimming pool surface to be cleaned. A preponderance of the main bristles are inclined such that, when their ends engage a horizontal pool bottom surface, the main bristles deviate from vertical in a common direction and vibration causes forward head movement.

The secondary bristles project both outwardly and downwardly and preferably terminate in secondary-bristle ends which are short of the common plane. Such secondary bristles are disposed at a rotational angle such that engagement of the secondary bristles with the pool bottom surface, or with pool side walls as the suction head bumps such side walls, causes a turning deflection of the pool cleaner. The secondary bristles at all locations around the secondary-bristle ring are oriented such that projections of such bristles on the aforementioned common plane would be angled (rather than straight) with respect to radii extending from such projections toward the center point of the common plane (that is, the point below the center of the housing). Thus, contact of any of such secondary bristles with the swimming pool wall would impart turning in one rotational direction—clockwise or counterclockwise.

The removably attached secondary-bristle ring is secured along the lower edge of the housing, preferably at a position outside (that is, radially outside) the removably attached main-bristle ring. A variety of devices can be used for such removable attachment.

BRIEF DESCRIPTION OF THE DRAWINGS

FIG. 1 is a perspective view of a preferred automatic swimming pool cleaner in accordance with this invention.

FIG. 2 is a front elevation of the device of FIG. 1.

Figure 4:
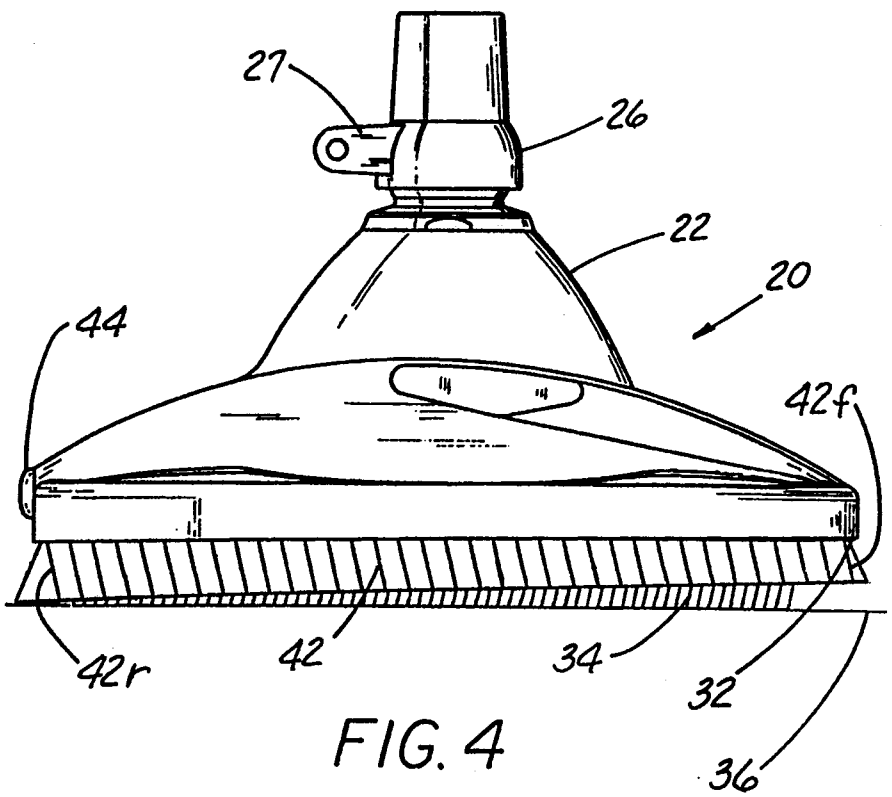
FIG. 4 is a side elevation.

As will be noted, for reasons of convenience several of the figures represent bristles somewhat schematically, rather than in actual form. The required characteristics of such bristles, however, is disclosed by such figures and by the written descriptions herein.

DETAILED DESCRIPTION OF PREFERRED EMBODIMENTS

FIG. 1 and all the other figures illustrate an automatic swimming pool cleaner suction head 20 having replaceably attached bristle rings 34*a* and 42*a* in accordance with this invention.

Suction head 20 has a housing 22, a chamber 24 (see FIGS. 6, 8 and 9) which is open at the lower side of housing 22, and a pivotable hose connection 26 on housing 22 allowing connection of a hose 28 through which a remote suction pump (not shown) causes water flow through chamber 24 and into hose 28, removing dirt and debris from the underwater surface of the pool. Lugs 27 at hose connection 26 may be used in attaching a pole (not shown) when the swimming pool cleaner is used in a manual mode.

As shown best in FIGS. 5, 6, 8 and 9, chamber 24 includes a central outflow portion 24*a* and a surrounding inflow portion 24*b* which extends to the periphery of housing 22. As shown in FIGS. 6–9 and 13, suction head 20 includes a vibrator 30 in outflow portion 24*a* of chamber 24. Vibrator 30 is pivotably secured to housing 22 by means of a shaft 30*a*, and is designed to freely oscillate within outflow chamber portion 24*a* in response to water flow through chamber portion 24*a*. As shown best in FIGS. 7 and 8, shaft 30*a* is journaled in holes 30*b* in housing 22 and is held in place by retainer plates 30*c* which are engaged with housing 22.

Figure 7:
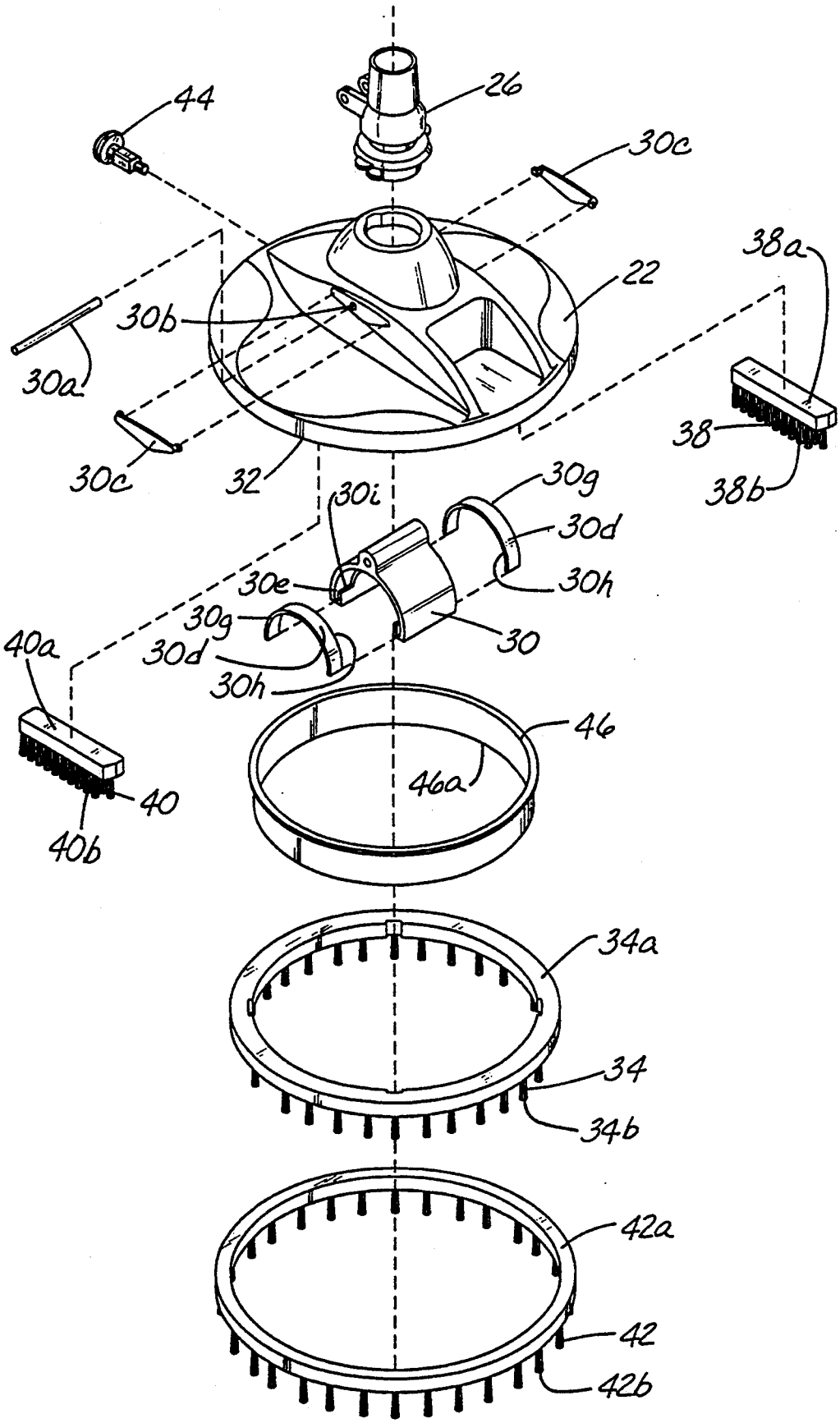
FIG. 7 is an exploded view.
Figure 9:
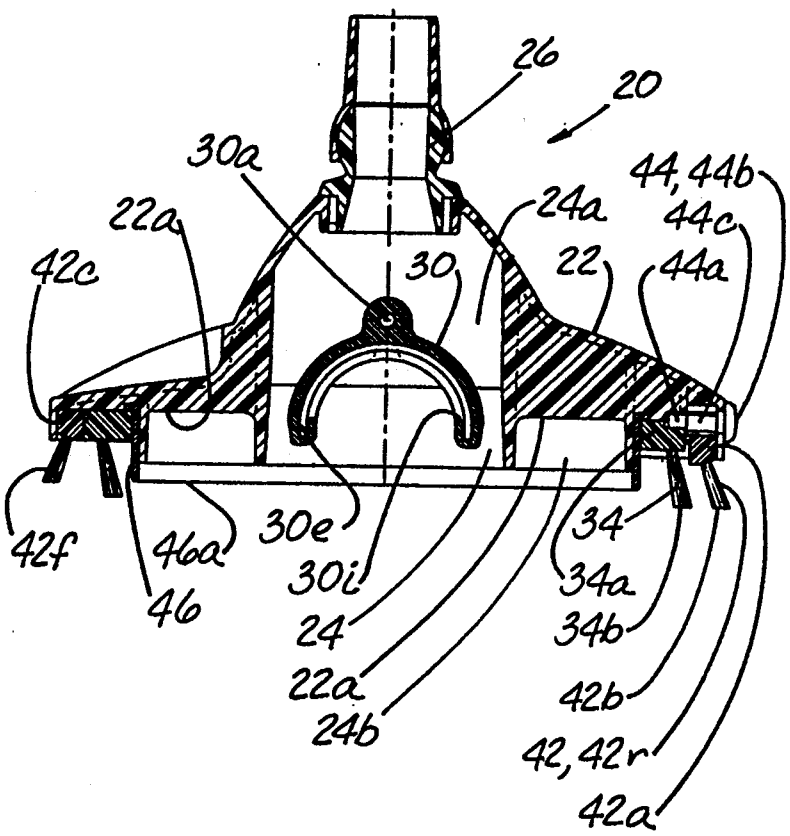
FIG. 9 is a sectional view taken along section 9—9 as indicated in FIG. 5.
Figure 13:
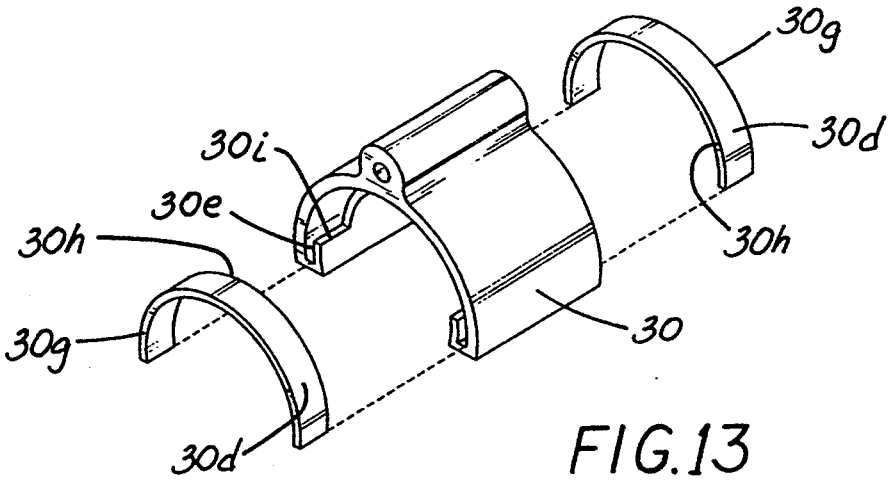
FIG. 13 is an enlarged exploded perspective view of the vibrator device used in the automatic swimming pool cleaner.

As shown in FIGS. 7, 9 and 13, vibrator 30 has a crescent-like or airfoil-like cross-section and is located in dome-like outflow chamber portion 24, with the convex side of vibrator 30 oriented toward hose connection 26. The profile and dimensions of vibrator 30 have been developed to provide a self-starting and relatively constant speed vibration which is powered by the flow of water up toward outlet hose 28. Flow of water causes an oscillation of vibrator 30, and the oscillatory momentum and impact forces (including movements of water mass) are imparted to housing 22 to cause vibratory motion.

As shown in FIGS. 6–8 and 13, a pair of arc-like sliding seals 30*d* are carried in lateral slots 30*e* on either opposite edge of vibrator 30 in position to engage opposed inner side walls 30*f* of chamber portion 24. Sliding seals 30*d* serve to seal vibrator 30 to side walls 30*f* and prevent excessive by-pass of water and yet allow sand or other small particles to escape to avoid clogging and lock-up and to avoid damage to parts. Sliding seals 30*d* can move inwardly as necessary to accommodate the passing of sand or other particles.

Sliding seals 30*d* are forced toward side walls 30*f* by the difference in hydraulic pressure between opposite edges of each of the sliding seals. Lower pressure fluid is exposed to seal outer edges 30*g* than is exposed to seal inner edges 30*h* (see FIGS. 6, 7, 8 and 13), and the higher pressure along seal inner edges 30*h* pushes seals 30*d* outwardly toward the lower pressure or suction sides of seal 30*d* (that is, in the direction toward seal outer edges 30*g*), causing engagement with side walls 30*f*.

As shown in FIGS. 6–9 and 13, best in FIG. 13, the lateral slot-forming portions of vibrator 30 have deep notches 30*i* which facilitate effective operation of the pressure differential in allowing pressure-driven outward movement of sliding seals 30*d*. Notches 30*i* also serve to fully expose much of the surfaces of seals 30*d*, allowing seals 30*d* to remain free to move within lateral slots 30*e*—by reducing or eliminating spaces where sand or dirt particles could accumulate to interfere with operation.

As already noted, vibrator 30 causes vibration of housing 22 as water passes through suction head 20. And, as in the invention of the above-noted patent, vibration acts through inclined bristles or other like flexures to cause forward movement of suction head 20. Housing 22 has a lower edge 32 which surrounds chamber 24, and removably secured along lower edge 32 are main bristles 34, such bristles forming something of an annulus of main bristles 34. More specifically, main bristles 34 are secured to a main-bristle ring 34*a* and such ring is removably secured to housing 22 along lower edge 32.

Figure 3:
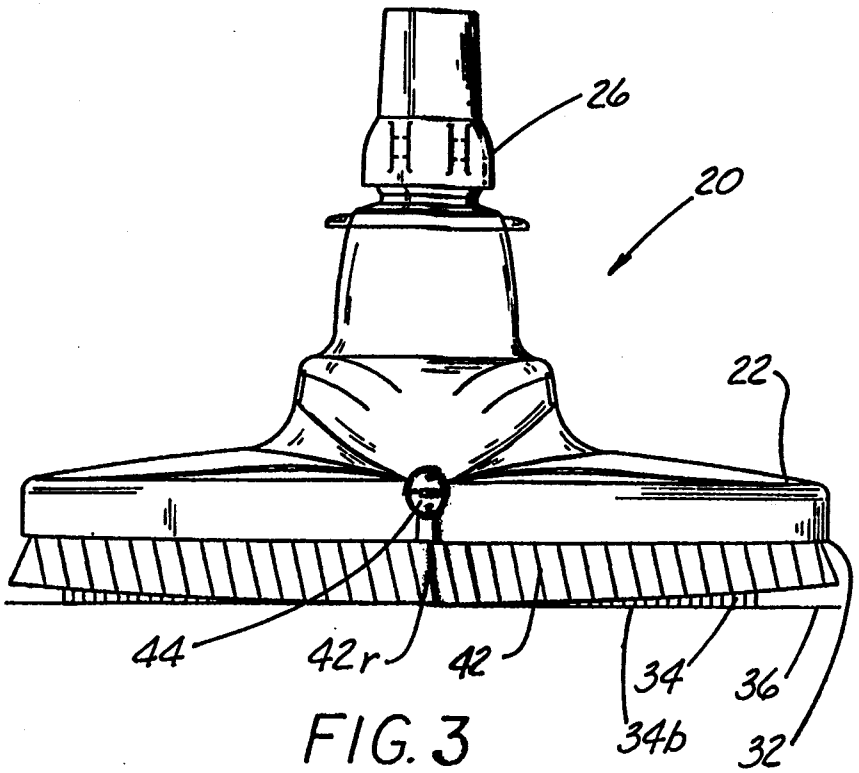
FIG. 3 is a rear elevation.

Main bristles 34 project downwardly to terminate in free main-bristle ends 34*b* which are disposed in a common plane and support suction head 20 on an underwater swimming pool surface to be cleaned. FIGS. 2–4 include a reference line 36 which is representative of a planar horizontal pool bottom surface, that is, a surface to be cleaned; as shown in FIGS. 2–4, such line is also representative of the common plane in which main-bristle ends 34*b* are disposed, given that in such views suction head 20 is supported by surface 36. The orientation of bristles will be described herein by reference to a vertical direction with respect to a horizontal surface such as that represented by reference line 36.

Figure 14:
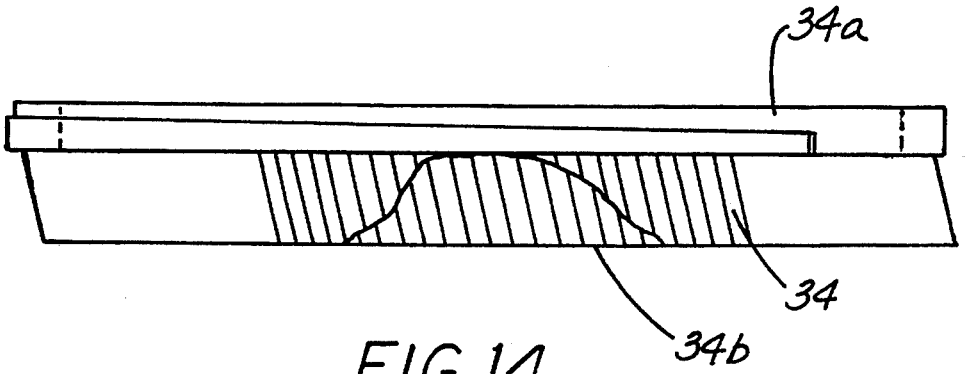
FIG. 14 is a partially cutaway side elevation of the main-bristle ring.

Main bristles 34 are affixed to main-bristle ring 34*a* at an angle; they deviate from vertical in a common direction at all locations about ring 34*a*. Such inclination, or deviation from vertical, is preferably about 8° to 18°, more preferably about 10° to 14°, with about 12° most preferred. This inclination of main bristles 34 about main-bristle ring 34*a* is illustrated best in FIG. 14, the breakaway portion of which shows that bristles on the far side of main-bristle ring 34*a* are angled in the same direction as those on the near side. Vibration of housing 22, acting through the combined rapid small motions of the many main bristles 34 about ring 34*b*, causes forward motion of suction head 20.

Suction head 20 has three groups of secondary bristles. These include two inside secondary-bristle groups 38 and 40 and an outer annulus of side secondary bristles 42 on a removably attached secondary-bristle ring 42*a*. All of such secondary bristles, during operation of suction head 20, are in fixed vertical positions, although adjustment is possible with respect to bristles 42 of secondary-bristle ring 42*a*. All of such secondary bristles are inclined, that is, deviate with respect to the vertical direction. Such angle of inclination is preferably about 8° to 18°, more preferably about 10° to 14°, with about 12° most preferred, but such bristles are mounted so that most are inclined in a direction or directions different than the direction of inclination of main bristles 34.

As earlier described, contact of secondary-bristle ends 42*b* with the surface to be cleaned as suction head 20 moves therealong such surface, causes turning in the direction of movement of suction head 20. That is, the vibration causes a turning of the head away from the forward direction by virtue of the vibratory action of the secondary bristles—as with the main bristles, but in a different, and therefore turning, direction. The extent of turning depends on the extent of secondary bristle end contact with the surface to be cleaned.

Secondary-bristle groups 38 and 40 are secured to the downwardly-facing middle surface 22*a* of housing 22, a surface surrounded by housing lower edge 32. See FIGS. 6–9 and 16. Secondary bristle groups 38 and 40 are secured to bristle blocks 38*a* and 40*a*, respectively, which are secured with respect to housing 22 such that the bristles of bristle groups 38 and 40 are in fixed vertical positions, with their bristle ends 38*b* and 40*b* at or about at the aforementioned common plane which is defined by main-bristle ends 34*b*.

Figure 6:
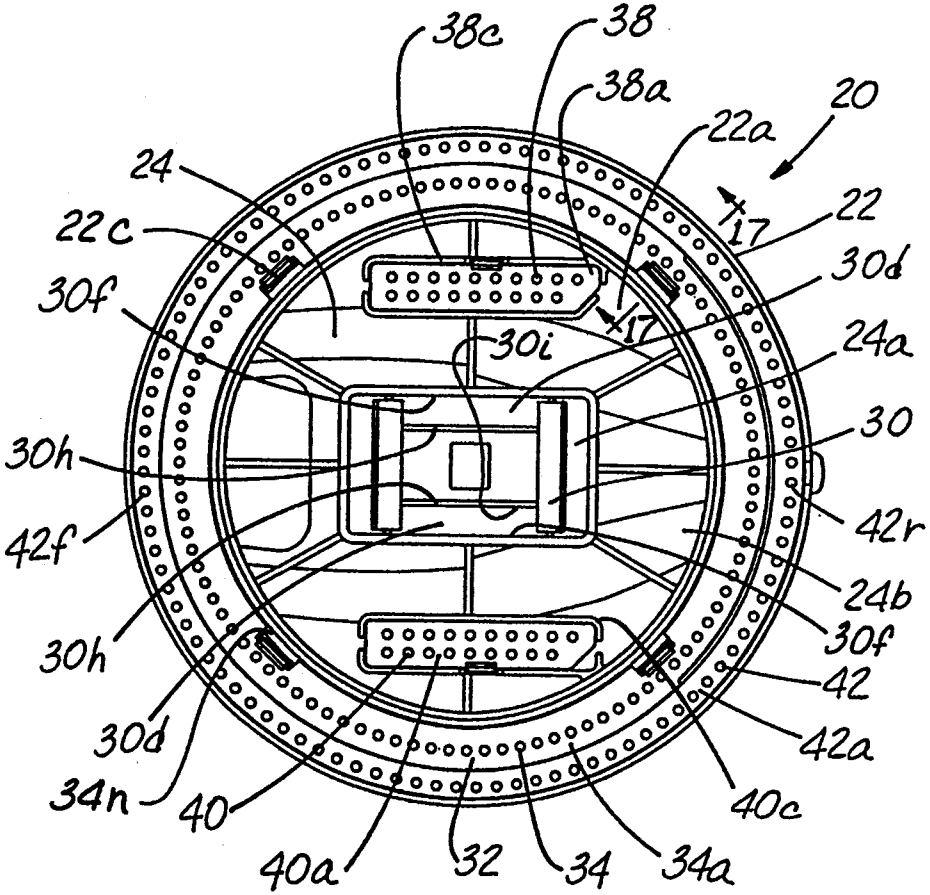
FIG. 6 is a bottom plan view.
Figure 5:
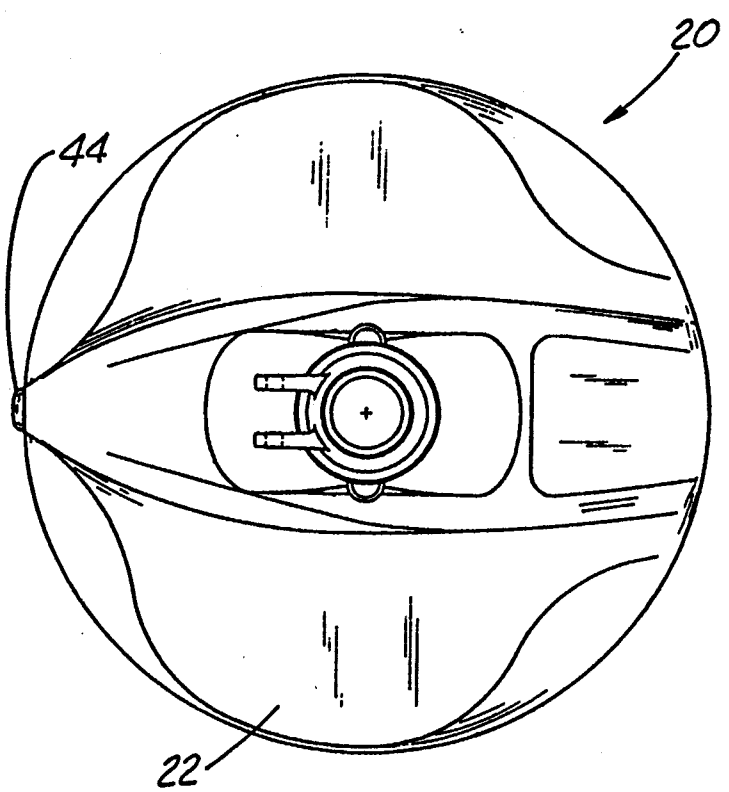
FIG. 5 is a top plan view.

As shown best in FIG. 6, bristle blocks 38*a* and 40*a* are attached within securement walls 38*c* and 40*c*, respectively, which are formed on (and are part of) downwardly-facing middle surface 22*a* of housing 22. Securement wall 38*c* is shaped with a tapered corner such that one of the bristle blocks, in this case bristle block 38*a*, can be secured therein in only one orientation—that is, with its secondary bristles 38 inclined in a direction different than the direction of inclination of main-bristles 34. Bristle block 38*a* cannot be reversed in its orientation. On the other hand, securement wall 40*c* is generally rectangular in shape without any irregular features which would limit the manner in which bristle block 40*a* is inserted therein.

Thus, bristle block 40*a* may be removed, reversed in orientation, reinserted and reattached within securement wall 40*c*, allowing its secondary bristles to be in either of at least two different orientations. The illustrated arrangement has secondary bristle groups 38 and 40 inclined in opposite directions—that is, in a common direction when considered rotationally—and this serves to impart an enhanced rotational motion to suction head 20, thus facilitating turning of suction head 22 from its direction of forward movement.

It has been found that the irregularities in the otherwise flat underwater surfaces of swimming pools—that is, portions which are off-flat or off-smooth surface—interact with secondary bristles as suction head 20 moves about a swimming pool under the vibratory action of main-bristles 34. More turning is achieved if the ends of the secondary bristles protrude more from the bottom of housing 22; less turning is achieved if the secondary-bristle ends are recessed a bit. It has been found that locating secondary bristle groups 38 and 40 such that bristle ends 38*b* and 40*b* are at or very near the aforementioned common plane provides ample random turning action. This turning action can be either enhanced or controlled by reversal of the orientation of bristle group 40.

Figure 8:
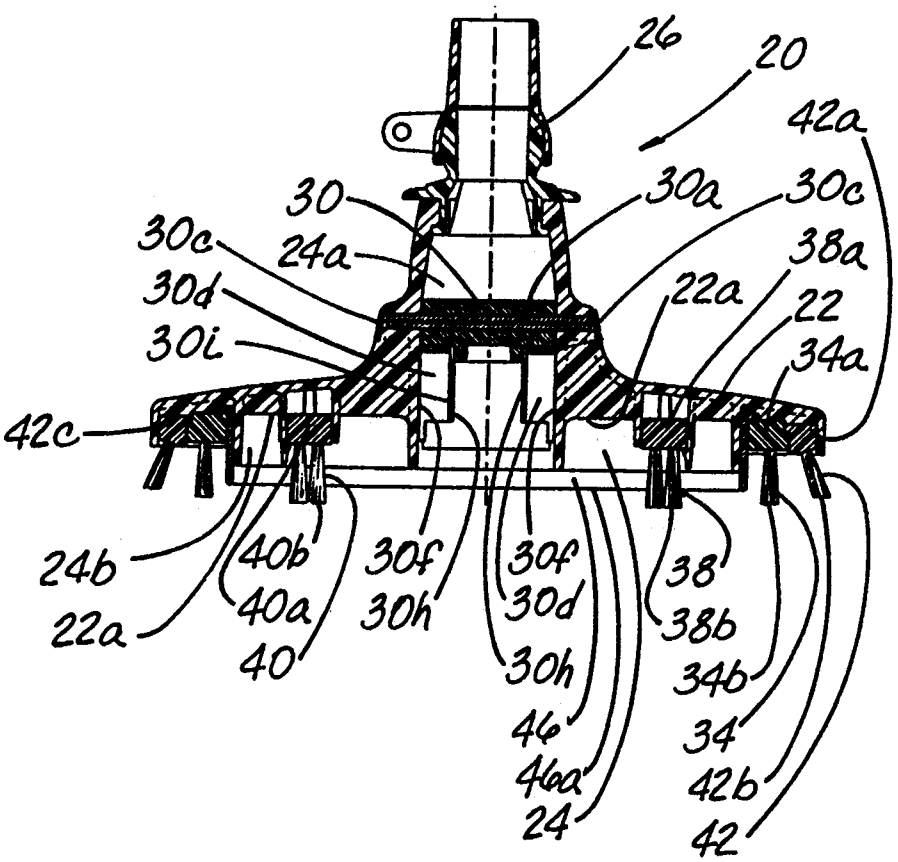
FIG. 8 is a sectional view taken along section 8—8 as indicated in FIG. 5.

As shown in FIGS. 2–4 and 6–9, best in FIGS. 8 and 9, ring 42*a* to which secondary bristles 42 (that is, "side" secondary bristles) are secured, is secured to housing lower edge 32 in a position which is concentric with main-bristle ring 34*a* at a position outside (that is, radially outside) main-bristle ring 34*a*. Both rings 34*a* and 42*a* are removably secured along lower edge 32, and may therefore be replaced when worn or removed for cleaning and readily reassembled with housing 22.

Figure 15:
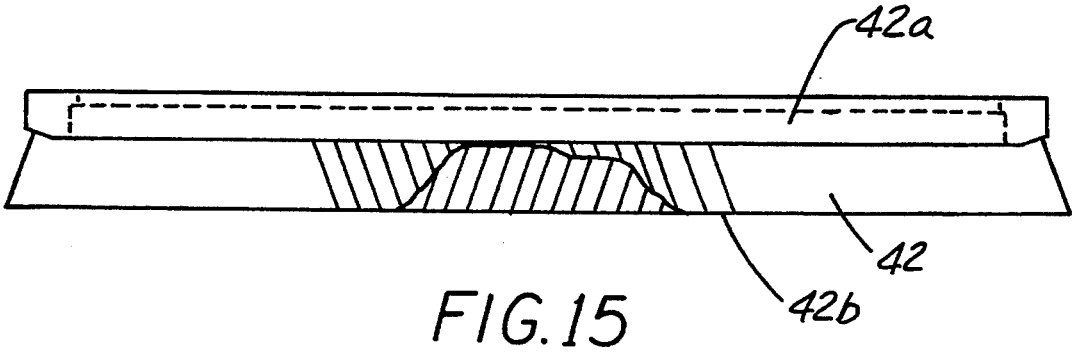
FIG. 15 is a partially cutaway side elevation of the secondary-bristle ring.
Figure 16:
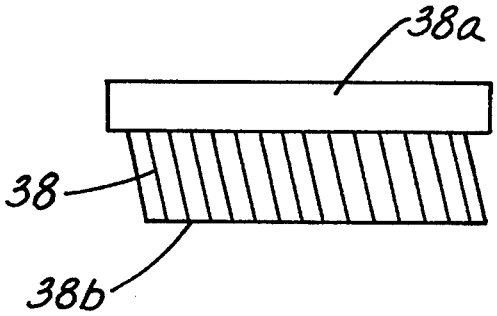
FIG. 16 is a partially cutaway side elevation of a secondary-bristle group.

Side secondary bristles 42 project both outwardly and downwardly and terminate short of the common plane indicated by reference line 36 (in FIGS. 2–4). As shown in FIG. 15, which includes a breakaway portion allowing illustration of bristle orientations on both the near side and the far side of secondary-bristle ring 42*a*, secondary bristles 42 are disposed at a common rotational angle—about 12° to vertical—such that engagement of bristle ends 42*b* with pool bottom surfaces causes a turning deflection of suction head 20. And, in addition to such rotational angle, bristles 42 are oriented to project radially outwardly, preferably about 16° to 24° from vertical, most preferably about 20°. This facilitates engagement with pool side walls as they are approached by suction head 20, and the combination of rotational and radial angling causes turning of suction head 20 when such bristles hit a side wall.

As shown in FIGS. 2–4, 6 and 9, secondary-bristle ring 41*a* is in a tilted orientation such that the ends of its rear bristles 42*r*, that is, its bristles generally along the rear circumferential portion of ring 42*a*, are at a lower position than are the ends of its front bristles 42*f*, that is, its bristles generally along the front circumferential portion of ring 42. The ends of the bristles of secondary-bristle ring 42 at circumferential portions between the front and the rear are at levels therebetween. The rear circumferential portion of secondary-bristle ring 42*a* is referred to herein as a low circumferential portion. Its level is because of the tilt of ring 42; all bristles 42 are of substantially equal lengths.

Not only is ring 42*a* tilted, but the extent of tilt of ring 42*a* is adjustable. As shown in FIGS. 8 and 9, the upper surface of ring 42*a* is against ring-placement surface 42*c* which is part of the under surface of housing 22 along housing lower edge 32. Ring-placement surface 42*c*, while planar, is tilted with respect to a horizontal plane such that ring 42*a* is tilted.

Figure 12:
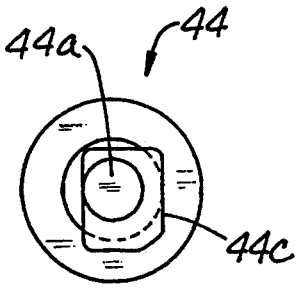
FIG. 12 is a left side elevation of FIG. 10, showing the other end of the height adjustment device.
Figure 10:
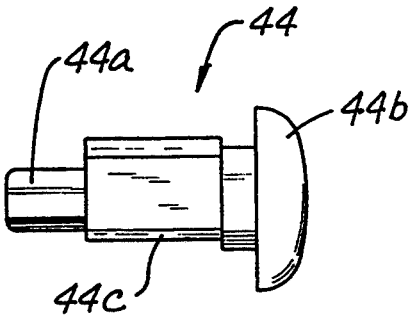
FIG. 10 is a side view of an adjustment device which is used for adjusting the vertical position of a portion of the secondary-bristle ring.
Figure 11:
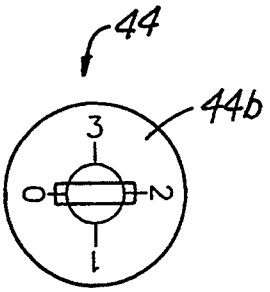
FIG. 11 is a right side elevation of FIG. 10, showing the head of the adjustment device.

As illustrated best in FIG. 9, between the rear circumferential portion of ring 42*a* and the adjacent portion of ring-placement surface 42*c* is a tilt-adjuster 44. Tilt-adjuster 44, shown in detail in FIGS. 10–12, has an inner end which is rotatably secured to housing 22, an outer end 44*b* by which the rotational orientation of tilt-adjuster 44 is set (for example, by using a screw driver), and a middle camming portion 44*c*. As shown best in FIG. 12, camming portion 44*c* has four sides, each of such sides having a different spacing from the axis of tilt-adjuster 44.

In the embodiment illustrated, tilt-adjuster 44 adjusts the tilt of secondary-bristle ring 42*a* between an orientation in which the ends of rear bristles 42*r* are at about the level of common plane 36 (and, thus, at about the level of main-bristle ends 34*b*) and an orientation in which the ends of rear bristles 42*r* are about three millimeters above common plane 36. Adjustments can be made to intermediate positions in which the ends of rear bristles 42*r* are either one or two millimeters above common plane 36. Outer end 44*b* of tilt-adjuster 44 is marked as a guide for such adjustment. When in its highest position of adjustment, the ends of front bristles 42*f* are still at a level about three millimeters above the level of the ends of rear bristles 42*r*.

This adjustability in the vertical positions of secondary-bristle ends 42*b* provides a further way to assure that the turning action provided by the secondary bristles of suction head 20 is appropriate for effective cleaning of a particular swimming pool.

As illustrated in FIGS. 6–9, a skirt 46, which is concentric with bristle rings 34*a* and 42*a*, projects downwardly from housing 22 at a position radially inside main-bristle ring 34. Bristle rings 34*a* and 42*a* and skirt 46 are dimensioned and configured for engagement with one another to facilitate assembly of suction head 20. Skirt 46 extends downwardly to a skirt lower edge 46*a* which is spaced well above the ends of both main bristles 34 and secondary bristles 42, that is, above the ends of the bristles of both bristle rings. Such spacing determines the gap through which water and debris will pass in entering housing chamber 24, and the gap must be small enough to assure sufficient turbulence of water flow at and between bristles as they engage the pool surface to be cleaned, and large enough to allow passage of dirt and debris.

Figure 17:
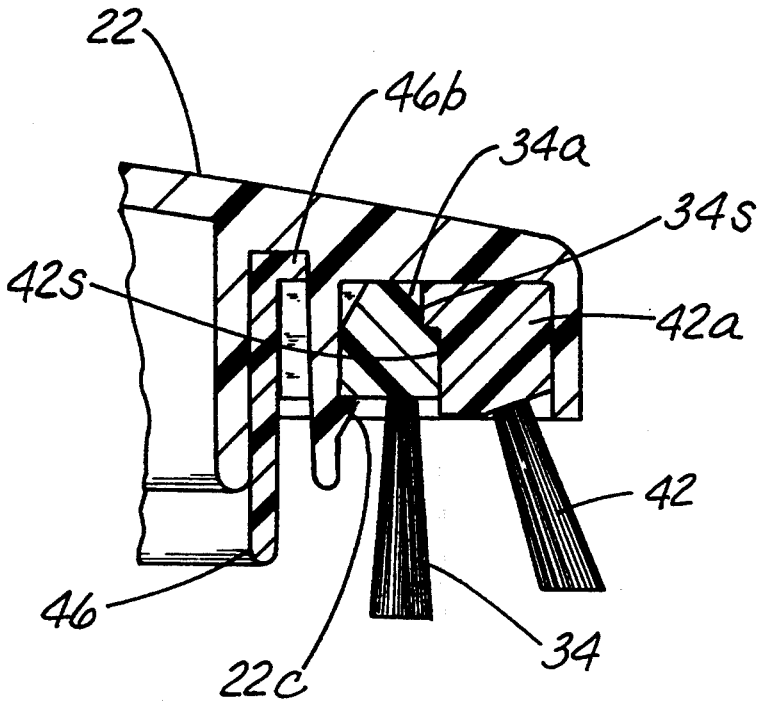
FIG. 17 is an enlarged sectional view taken along section 17—17 as indicated in FIG. 6.

FIGS. 6 and 17 illustrate a preferred means for removable attachment of main-bristle ring 34a, secondary-bristle ring 42*a*, and skirt 46 to housing 22. As shown in FIG. 6, main bristle ring 34*a* has four notches 34*n* distributed around its inner diameter. Notches 34*n* are configured to receive four clips 22*c*, which are integral with housing 22, to attach main bristle ring 34*a* to housing 22.

FIG. 17, a sectional view at a notch 34*n*, shows in detail the means by which main-bristle ring 34*a* assists in removable attachment of secondary-bristle ring 42*a* (and skirt 46) to housing 22. The inner diameter surface 42*s* of secondary-bristle ring 42*a* is complementary with the outer diameter surface 34*s* of main-bristle ring 34*a*, such that attachment of main-bristle ring 34*a* holds secondary-bristle ring 42*a* securely in place. Further, skirt 46 has a skirt flange 46*b* which rests atop main-bristle ring 34*a*, securing it in place in a similar fashion.

Many other variations are possible in arrangement and configuration of the removably attached bristle rings, as well as in arrangement and configuration of main bristles, secondary bristles and bristle groups, and other parts as required. It should be noted that the term "bristles" is used herein to refer to any flexible and resilient flexure material which can extend downwardly, as common bristles do (as shown), to support the suction head housing and allow its advance by means of the vibratory action of housing 22.

The parts of this invention may be made using known materials, and molding and forming methods well known to those skilled in the art. Housing 22, vibrator 30, hose connector 26, tilt-adjuster 44, and the rings and blocks for bristle mounting are preferably made of suitable rigid plastics. Housing 22 can be molded with all or most of its required functional elements and features integrally formed as parts or features thereof. The bristles are preferably made of common bristle materials which are flexible and resilient, and thus facilitate the moving actions described above. Sliding seals 30*d* are made of fairly rigid seal materials, one preferred material being a Dupont Delrin acetal material.

A wide variation of materials, part manufacturing methods and assembly methods can be used.

While the principles of this invention have been described in connection with specific embodiments, it should be understood clearly that these descriptions are made only by way of example and are not intended to limit the scope of the invention.

We claim:

1. In a swimming pool cleaner suction head of the self-propelled automatic type having a housing, a chamber open at its lower side and a hose connection by which a pump causes water flow through the chamber and into the hose, the improvement comprising the housing having a lower edge surrounding the chamber; and a continuous, one-piece bristle ring detachably secured to the housing at the lower edge, the bristle ring defining an axis and having bristles secured along it and projecting downwardly to terminate in bristle ends, the bristle ends forming the sole support for the suction head on a surface to be cleaned, a preponderance of the bristles being inclined along lines which are skew lines with respect to the axis, such that vibration of the housing and bristle orientation cause movement of the pool cleaner along a swimming pool bottom surface.

2. The apparatus of claim 1 wherein the bristle ring is a primary bristle ring and further including a secondary bristle ring detachably secured to the housing adjacent to the primary bristle ring, the secondary bristle ring having bristles secured therealong and projecting downwardly therefrom.

3. The apparatus of claim 2 wherein the primary and secondary bristle rings have interengaging adjoining annular surfaces.

4. The apparatus of claim 3 wherein the adjoining surfaces are complementary.

5. The apparatus of claim 1 further including means for detachably securing the bristle ring to the housing.

6. A continuous, one-piece bristle ring for removable attachment to a swimming pool cleaner which has a housing with a lower edge along which the ring is attachable, a chamber open at its lower side and surrounded by the lower edge and a hose connection through which a pump causes water flow through the chamber and into the hose, such bristle ring defining an axis and having: bristles secured along it and projecting downwardly to terminate in bristle ends, the bristle ends forming the sole support for the pool cleaner on a surface to be cleaned, a preponderance of the bristles being inclined along lines which are skew lines with respect to the axis, such that vibration of the housing and the bristle orientation cause movement of the pool cleaner along a swimming pool bottom surface; and means on the ring to facilitate removable attachment of the ring to the housing.

7. The bristle ring of claim 6 wherein such bristle ring is a first bristle ring, the first bristle ring is associated with a second bristle ring and the first bristle ring has an annular surface with features for interengagement with the second bristle ring.

8. The first bristle ring of claim 7 wherein the annular surface is complementary to an adjoining annular surface of the second bristle ring.

* * * * *

UNITED STATES PATENT AND TRADEMARK OFFICE

CERTIFICATE OF CORRECTION

PATENT NO. : 5,428,854

DATED : July 4, 1995

INVENTOR(S) : Dieter J. Rief and Herman E. Frentzel

It is certified that error appears in the above-indentified patent and that said Letters Patent is hereby corrected as shown below:

On the cover sheet under the heading of Related U.S. Application Data, on the first line, change "April 30" to --April 27--.

In column 1, line 60, after "in", insert --copending--.

In column 2, line 40, delete "10".

In column 8, line 7, change "41a" to --42a--.

Signed and Sealed this

Third Day of October, 1995

*Attest:*

BRUCE LEHMAN

*Attesting Officer*

*Commissioner of Patents and Trademarks*